US009611738B2

(12) United States Patent
Shook

(10) Patent No.: US 9,611,738 B2
(45) Date of Patent: Apr. 4, 2017

(54) VENTILATED MINE ROOF SUPPORT

(71) Applicant: BURRELL MINING PRODUCTS, INC., New Kensington, PA (US)

(72) Inventor: Michael T. Shook, New Kensington, PA (US)

(73) Assignee: BURRELL MINING PRODUCTS, INC., New Kensington, PA (US)

( * ) Notice: Subject to any disclaimer, the term of this patent is extended or adjusted under 35 U.S.C. 154(b) by 156 days.

(21) Appl. No.: 14/470,730

(22) Filed: Aug. 27, 2014

(65) Prior Publication Data

US 2016/0061032 A1 Mar. 3, 2016

(51) Int. Cl.

| | |
|---|---|
| ***E21D 15/00*** | (2006.01) |
| ***E21F 1/00*** | (2006.01) |
| ***E21D 15/48*** | (2006.01) |
| ***E21F 1/10*** | (2006.01) |

(52) U.S. Cl.

CPC ..... *E21F 1/10* (2013.01); *E21D 15/48* (2013.01)

(58) Field of Classification Search

CPC ... E21F 1/00; E21F 1/003; E21F 1/006; E21F 1/04; E21F 1/06

USPC ..... 454/168; 52/220.8, 834

See application file for complete search history.

(56) References Cited

U.S. PATENT DOCUMENTS

| | | | | |
|---|---|---|---|---|
| 31,777 A | | 3/1861 | Boynton | |
| 82,663 A | | 9/1868 | Walters | |
| 87,016 A | | 2/1869 | Walters | |
| 456,646 A | | 7/1891 | Clark | |
| 614,729 A | | 11/1898 | Lally | |
| 881,609 A | | 3/1908 | Nellen | |
| 987,397 A | | 3/1911 | Pittroff | |
| 1,895,053 A | | 1/1933 | Staley | |
| 1,971,051 A | | 8/1934 | Reiner | |
| 2,508,949 A | * | 5/1950 | Howard | E21F 7/00 299/12 |
| 2,510,688 A | | 6/1950 | Evans | |
| 3,188,041 A | | 6/1965 | Town | |
| 3,196,061 A | | 7/1965 | Paulson | |
| 3,648,960 A | | 3/1972 | Krekeler | |
| 4,052,029 A | | 10/1977 | Townsend | |
| 4,167,361 A | | 9/1979 | Petro | |
| 4,185,940 A | | 1/1980 | Spies | |
| 4,192,479 A | | 3/1980 | Friebe | |
| 4,195,111 A | | 3/1980 | Rautenbach | |

(Continued)

FOREIGN PATENT DOCUMENTS

| | | |
|---|---|---|
| CN | 95107473 A | 1/1996 |
| CN | 202531206 U | 11/2012 |

(Continued)

OTHER PUBLICATIONS

Yield test report, conducted by NIOSH Safety Structures Testing Laboratory for Jennmar Corporation, relating to Big John Yield Props, Feb. 5, 2002, pp. 1-15.

*Primary Examiner* — Benjamin Fiorello
*Assistant Examiner* — Stacy Warren
(74) *Attorney, Agent, or Firm* — Morriss O'Bryant Compagni, PC

(57) ABSTRACT

A longitudinally yieldable support for underground roof support includes an elongate outer shell filled with a solid compressible filler material. At least one air ventilation tube extends between opposite sides of the support to allow a flow of air through the support as the support yields.

33 Claims, 13 Drawing Sheets

(56) References Cited

U.S. PATENT DOCUMENTS

| | | | | |
|---|---|---|---|---|
| 4,249,837 | A | 2/1981 | Spies | |
| 4,255,071 | A * | 3/1981 | Koppers | E21D 15/02 248/354.1 |
| 4,277,204 | A | 7/1981 | Koppers | |
| 4,281,487 | A | 8/1981 | Koller | |
| 4,309,059 | A | 1/1982 | Walsh | |
| 4,332,512 | A | 6/1982 | Heintzmann et al. | |
| 4,425,057 | A | 1/1984 | Hahn | |
| 4,497,597 | A | 2/1985 | Chlumecky | |
| 4,520,980 | A | 6/1985 | Townsend | |
| 4,534,531 | A | 8/1985 | Brown | |
| 4,565,469 | A | 1/1986 | Chlumecky | |
| 4,664,563 | A | 5/1987 | Christman | |
| 4,712,947 | A | 12/1987 | Thom | |
| 4,726,714 | A | 2/1988 | MacArthur | |
| 4,770,564 | A | 9/1988 | Dison | |
| 4,773,792 | A | 9/1988 | Landers | |
| 4,915,339 | A | 4/1990 | Halbich | |
| 4,983,077 | A | 1/1991 | Sorge | |
| 5,013,157 | A | 5/1991 | Mills | |
| 5,015,125 | A | 5/1991 | Seegmiller | |
| 5,051,039 | A | 9/1991 | Heiliger | |
| 5,143,340 | A | 9/1992 | Wood | |
| 5,143,484 | A | 9/1992 | Deul | |
| 5,165,824 | A | 11/1992 | Corcoran | |
| 5,273,378 | A | 12/1993 | Merz | |
| 5,308,196 | A | 5/1994 | Frederick | |
| 5,342,150 | A | 8/1994 | Kitchen | |
| 5,400,994 | A | 3/1995 | Shawwaf | |
| 5,413,436 | A | 5/1995 | Merz | |
| 5,439,325 | A * | 8/1995 | Kitchen | E21D 15/12 248/357 |
| 5,669,739 | A | 9/1997 | Clarke | |
| 5,720,581 | A | 2/1998 | Bacon | |
| 5,772,169 | A | 6/1998 | Blockley | |
| 5,868,527 | A | 2/1999 | King | |
| 5,921,718 | A | 7/1999 | Kolk | |
| 6,056,480 | A | 5/2000 | Kolk | |
| 6,196,635 | B1 | 3/2001 | Rohaly | |
| 6,394,707 | B1 | 5/2002 | Kennedy | |
| 6,499,916 | B2 | 12/2002 | Marianski | |
| 6,558,085 | B1 | 5/2003 | Hall | |
| 6,655,877 | B2 | 12/2003 | Calhoun | |
| 6,910,834 | B2 | 6/2005 | Harbaugh | |
| 7,232,103 | B2 | 6/2007 | Heath | |
| 7,909,542 | B2 | 3/2011 | Erasmus et al. | |
| 8,052,352 | B2 | 11/2011 | Bolton | |
| 8,246,276 | B2 | 8/2012 | Bower et al. | |
| 8,851,805 | B2 | 10/2014 | Shook et al. | |
| 2002/0136607 | A1 | 9/2002 | Merz | |
| 2003/0194280 | A1 | 10/2003 | Calhoun | |
| 2004/0240948 | A1 | 12/2004 | Harbaugh et al. | |
| 2007/0092344 | A1 * | 4/2007 | Erasmus | E21D 15/483 405/288 |
| 2011/0262231 | A1 | 10/2011 | Hussey | |
| 2012/0009023 | A1 | 1/2012 | Bower | |
| 2013/0108376 | A1 | 5/2013 | McCartney | |
| 2013/0149044 | A1 | 6/2013 | Barnett | |
| 2014/0064859 | A1 | 3/2014 | Shook | |

FOREIGN PATENT DOCUMENTS

| | | | |
|---|---|---|---|
| DE | 2410976 | | 9/1974 |
| EP | 0040096 | A1 | 11/1981 |
| EP | 0089403 | A1 | 9/1983 |
| EP | 0128964 | A1 | 12/1984 |
| EP | 0160133 | A1 | 6/1985 |
| GB | 2070666 | A | 9/1981 |
| GB | 2081340 | A | 2/1982 |
| GB | 2125465 | A | 3/1984 |
| GB | 2149440 | A | 6/1985 |
| GB | 2330596 | A | 4/1999 |
| WO | 9534743 | A1 | 12/1995 |
| WO | 9850683 | A1 | 11/1998 |
| WO | 0114692 | A1 | 3/2001 |
| WO | 2011133798 | A1 | 10/2011 |
| WO | 2012016272 | A1 | 2/2012 |
| WO | 2012056393 | A1 | 5/2012 |
| ZA | 763597 | | 6/1976 |
| ZA | 763598 | | 6/1976 |
| ZA | 775286 | | 8/1977 |
| ZA | 775348 | | 9/1977 |
| ZA | 784964 | | 3/1978 |
| ZA | 784881 | | 8/1978 |
| ZA | 785331 | | 9/1978 |
| ZA | 787331 | | 12/1978 |
| ZA | 802821 | | 5/1980 |
| ZA | 804801 | | 8/1980 |
| ZA | 805978 | | 9/1980 |
| ZA | 806817 | | 11/1980 |
| ZA | 806944 | | 11/1980 |
| ZA | 812905 | | 5/1981 |
| ZA | 814868 | | 7/1981 |
| ZA | 814869 | | 7/1981 |
| ZA | 815000 | | 7/1981 |
| ZA | 815001 | | 7/1981 |
| ZA | 815002 | | 7/1981 |
| ZA | 815085 | | 7/1981 |
| ZA | 815169 | | 7/1981 |
| ZA | 815170 | | 7/1981 |
| ZA | 836147 | | 8/1983 |
| ZA | 836286 | | 8/1983 |
| ZA | 838402 | | 11/1983 |
| ZA | 838403 | | 11/1983 |
| ZA | 847218 | | 9/1984 |
| ZA | 847219 | | 9/1984 |
| ZA | 852380 | | 3/1985 |
| ZA | 860510 | | 1/1986 |
| ZA | 860723 | | 1/1986 |
| ZA | 877215 | | 9/1987 |
| ZA | 901210 | | 2/1990 |
| ZA | 901984 | | 3/1990 |
| ZA | 910910 | | 2/1991 |
| ZA | 915093 | | 7/1991 |
| ZA | 927149 | | 9/1992 |
| ZA | 933156 | | 5/1993 |
| ZA | 934418 | | 6/1993 |
| ZA | 961864 | | 3/1996 |
| ZA | 974419 | | 5/1997 |
| ZA | 977556 | | 8/1997 |
| ZA | 978946 | | 10/1997 |
| ZA | 984887 | | 6/1998 |
| ZA | 20001460 | | 3/2000 |
| ZA | 20002789 | | 6/2000 |
| ZA | 20029937 | | 12/2002 |

* cited by examiner

VENTILATED MINE ROOF SUPPORT

BACKGROUND

Field of the Invention

The present invention relates generally to an underground mine roof support for supporting the roof, and, more particularly, to a yieldable mine roof support that allows ventilation air to pass through the mine roof support to increase air flow within a mine entry in which a plurality of the mine roof supports according to the present invention are installed.

Description of the Related Art

Over the past several years, Burrell Mining Products, Inc. of New Kensington, Pa. has successfully marketed and sold a mine roof support product sold under the trademark THE CAN®. THE CAN support is comprised of an elongate metal shell that is filled with aerated concrete. The use of aerated concrete in THE CAN support allows the support to yield axially and/or biaxially in a controlled manner that prevents sudden collapse or sagging of the mine roof and floor heaving. THE CAN support yields axially as the aerated concrete within the product is crushed and maintains support of a load as it yields.

A typical size of THE CAN support is approximately six feet (1.8 meters) in height and two feet (0.6 meters) in diameter. The overall height of THE CAN supports is based on the average size of the mine entry with each support being of a height that is less than an average height of the mine entry in which the supports are to be installed. In order to install each support, wood planks (or other appropriate cribbing materials such as aerated concrete blocks) are placed beneath THE CAN support to level the support and additional wood planks or other cribbing materials are placed on top of the support until the space between the support and the roof is filled. Essentially, the cribbing materials are tightly wedged between the support and the roof so as to cause each THE CAN support to bear a load of the roof upon installation.

In order to adequately support the roof of a mine entry, a number of THE CAN supports are installed using the previously described method. The supports are typically installed in rows and columns according to mine engineering specifications to provide a desired level of support within the mine entry. Because a number of the supports are installed in the entry, and the fact that the supports are often staggered or offset within the mine entry, even though ventilation air can circulate around the supports, the presence of the supports within the mine entry still impedes the flow of air through the entry. Any increase in ventilation air flow is highly desired in underground mining so that fresh, breathable air is provided to mine personnel while potentially dangerous gases are evacuated and prevented from building within the mine atmosphere.

Thus, it would be advantageous to provide a mine roof support that is capable of supporting loads comparable to THE CAN mine roof support, but that also increases the flow of ventilation air through a mine entry in which such supports are installed. This and other advantages will become apparent from a reading of the following summary of the invention and description of the illustrated embodiments in accordance with the principles of the present invention.

SUMMARY OF THE INVENTION

Accordingly, a support is comprised of a first elongate metal tube containing a crushable or compressible core material that allows controlled yielding of the support along its length. At least one second elongate tube is coupled to the first elongate tube in a direction that is orthogonal to a long axis of the first elongate tube with the ends of the second elongate tube forming apertures in opposite sides of the first elongate tube, essentially forming an elongate hole completely through the second elongate tube. The core encapsulates the sides of the second elongate tube and otherwise completely fills the first elongate tube.

In one embodiment, the support is comprised of an outer steel shell formed in the shape of an elongate tube. At least one steel tube is attached to shell and transversely extends between opposite sides of the shell. The open ends of the tube form apertures in the opposite sides of the shell to which the tube is attached. An aerated or other lightweight concrete or cement is poured into the elongate tube to substantially fill the entire length of the tube and encapsulate the sides of the at least one tube. Once the concrete is set, the concrete will bond to the inside surface of the shell and to the outside surfaces of the at least one tube further securing the location of the at least one tube relative to the shell so as to prevent the at least one tube from becoming dislodged from or displaced relative to the elongate tube. The use of a lightweight cement containing lightweight aggregate or air pockets allows the cement to be crushed within the outer shell thus allowing axial yielding of the support along its length as the lightweight concrete is compressed. The tube, however, is structurally configured to resist collapse as the shell and lightweight concrete yield and are compressed. This allows the support to continue to enhance ventilation through the mine entry even when the mine entry has undergone significant collapse and the support as completely or nearly completely yielded.

In another embodiment, the support is comprised of an outer steel shell formed in the shape of an elongate tube. At least two steel tubes are attached to shell and transversely extend between opposite sides of the shell. The steel tubes are substantially aligned in parallel so that the side openings in the supports formed by the steel tubes can be oriented to face a direction of the flow of ventilation air within the entry. Again, an aerated or other lightweight concrete or cement is poured into the elongate tube to substantially fill the entire length of the tube and encapsulate the sides of the tubes. Once the concrete is set, the concrete will bond to the inside surface of the shell and to the outside surfaces of the tubes further securing the location of the tubes relative to the shell so as to prevent the tubes from becoming dislodged from or displaced relative to the elongate tube. The tubes are structurally configured to resist collapse as the shell and lightweight concrete yield and are compressed to allow ventilation flow through the support as the support continues to yield.

In yet another embodiment, a single large aperture is provided that has a sufficient diameter to allow a flow of air through the support and has a tube wall thickness of the ventilation tube sufficient to resist collapse of the ventilation tube as the support yields under pressure.

In another embodiment, the compressible filler material has a density of between about 40 and 60 $lb/ft^3$.

In another embodiment, the compressible filler material is aerated concrete having a density of about 50 $lb/ft^3$.

In another embodiment, the support is capable of supporting a load of between approximately 100,000 lbs and 300,000 lbs as the support yields under load.

In still another embodiment, the outer shell will fold upon itself as the support yields.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings.

DETAILED DESCRIPTION OF THE ILLUSTRATED EMBODIMENTS

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. Thus, the full scope of the inventions is not limited to the examples that are described below.

Figure 1A:
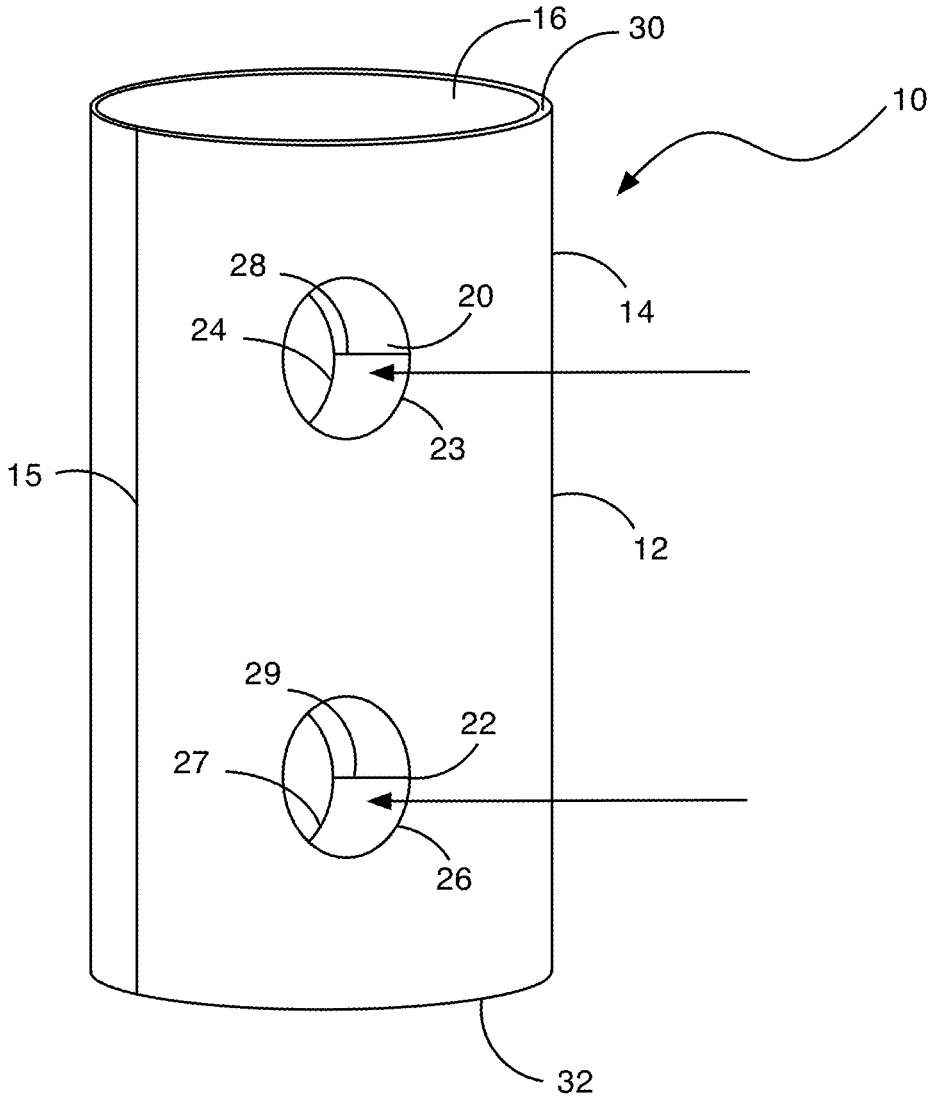
FIG. 1A is a perspective side view of a first embodiment of a support in accordance with the principles of the present invention.

FIG. 1A illustrates a first embodiment of a mine roof support in exploded form, generally indicated at 10 in accordance with the principles of the present invention. The support 10 may be utilized in various underground support situations including without limitation underground mine roof support, various tunnel applications or the like. The support 10 is comprised of a support section 12 that is comprised of an outer shell 14 in the form of a tube that is prefilled with a primary compressible filler material 16, such as an aerated concrete aerated grout, foam or other suitable material known in the art. The outer shell 14 may be comprised of a sheet of metal, such as steel, that is rolled into a cylinder and welded along a seam 15 that extends the longitudinal length of the outer shell 14. The support 10 is configured to be positioned in a desired location within a mine entry to support the roof of the mine and control convergence between the floor and the roof of the mine entry. Transversely extending tubes 20 and 22 are coupled to the outer shell 14 and extend across the support section 12. The tube 20 extends between apertures 23 and 24 formed on opposing sides of the shell 14. The tube 22 extends between apertures 26 and 27 formed on the opposing sides of the shell 14 below the apertures 23 and 24. The tubes 20 and 22 may be formed from a sheet of steel that is rolled into a cylinder shape and then welded along seams 28 and 29, respectively. Each tube 20 and 22 can then be attached to the shell 14 as by welding along the apertures 23, 24, 26 and 27, respectively. The long axis of the tubes 20 and 21 are substantially vertically aligned and substantially parallel relative to one another. The long axis of tubes 20 and 22 are also substantially horizontally oriented at right angles to the long axis of the shell 14 so that the tubes 20 and 22 transversely extend across the shell 14.

The center of the tube 20 is positioned approximately one third the overall length of the shell 14 from the top 30 of the support section 12. The center of the tube 22 is positioned approximately one third the overall length of the shell 14 from the bottom 32 of the support section 12. Spacing the tubes 20 and 22 the same distance from respective ends of the shell 14 allows the support 10 to be oriented in the mine entry with either end up and spaces the bottom tube 20 or 22, as the case may be depending on such orientation, so that as the support 10 yields the bottom tube 20 or 22 remains positioned above any ground water that may be present in the mine entry. It is noted that the vertical position of the tubes relative to the support can be varied based on the overall height of the support. For longer supports, the tubes can be placed closer to the center of the support or nearer the ends of the support as desired. The tubes, however, are spaced from the ends of the support to allow initial yielding of the top and/or bottom end of the support before such yielding occurs proximate the tubes as the supports tend to yield first at one or both ends of the support before yielding in the center of the support.

The shell 14 and filler material 16 work in tandem as the support 10 yields under load to allow vertical or longitudinal compression of the support 10 while maintaining support of the load. That is, the support 10 will longitudinally yield for a given displacement or yield dimension without catastrophic failure under load. In addition, the tubes 20 and 22 allow ventilation air, represented by arrows, to flow through the support 10 as the support 10 yields.

The filler material may be comprised of aerated or "foamed" concrete or cement. Use of aerated concrete is particularly beneficial because it can be cast in the outer shell 14 substantially along its entire length and the strength or compressibility characteristics of the aerated concrete is relatively uniform and predictable to produce a desired compressive strength to weight ratio. The use of aerated concrete, in which small air cells are formed within the concrete, in the support section 12 is well proven and has been reliably used in roof supports for years. In addition, once set, aerated concrete once cured forms a solidified, unitary structure that will remain contained within the outer shell 14 during handling and will not settle within the outer shell 14, as may be the case when using loose materials, such as saw dust or pumas. In a support application, settling of the filler material 16 is a major concern since any settling will result in larger displacement or yielding of the support before the support begins to carry a load. The filler material 16 is added to the shell 14 as by pouring after the tubes 20 and 22 have been secured in place in the shell 14. As the aerated concrete is poured into and fills the shell 14, the aerated concrete flows around the outside of each tube 20 and 22. Once cured, the aerated concrete 16 holds each tube 20 and 22 in place. In addition, the aerated concrete 16 provides lateral support to the tubes 20 and 22 as they are subjected to pressure as the support 10 yields to resist collapse of the tubes 20 and 22. By using an aerated concrete, the filler material is not susceptible to shrinkage and thus will continue to support the roof even after long periods of time.

Figure 1B:
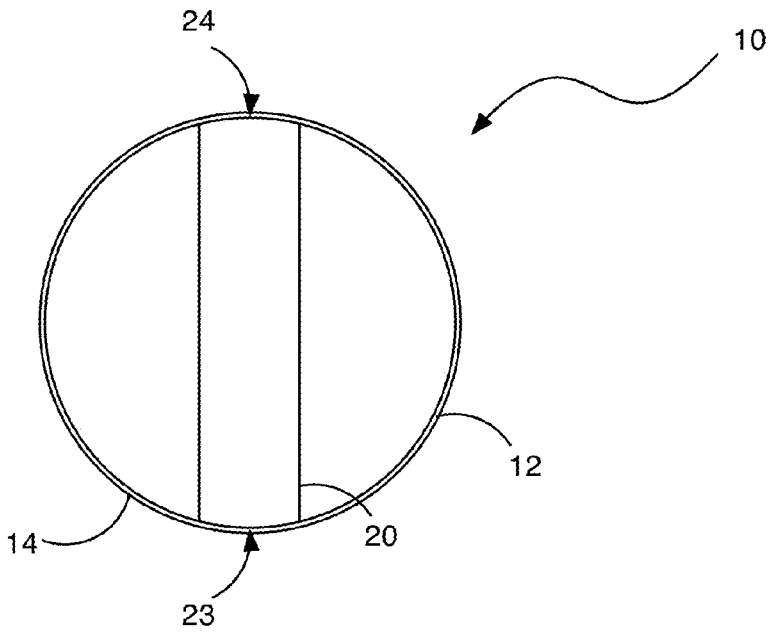
FIG. 1B is a top view of the support shown in FIG. 1A.
Figure 1C:
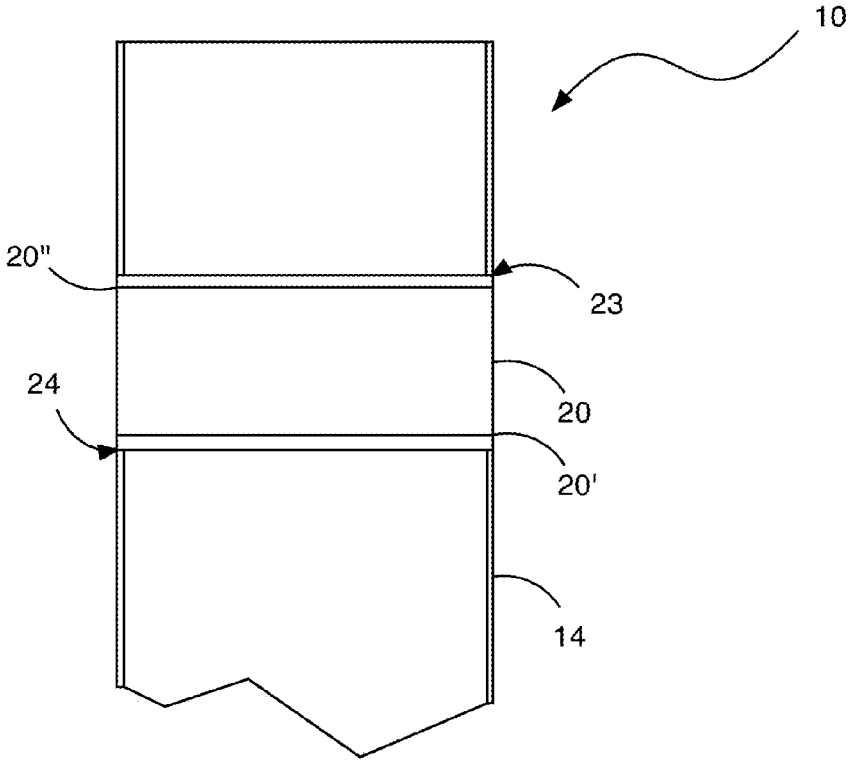
FIG. 1C is a partial cross-sectional side view of the support shown in FIG. 1A.

As shown in FIGS. 1B and 1C, each tube, such as tube 20, diametrically extends across the shell 14 of support section 12 between apertures 23 and 24. The tube 20 may have a length substantially equal to a diameter of the shell 14 so that the ends of the tube 20 are positioned proximate the outer surface of the shell 14 at the apertures 23 and 24. In this position, the ends 20' and 20" of the tube 20 can be welded to the shell 14 around each respective aperture 23 and 24. Thus, the outer diameter of the tube 20 is approximately equal to an just slightly smaller than the diameters of the apertures 23 and 24 to allow the tube 20 to be inserted through the apertures 23 and 24 and welded to the shell 14.

Figure 2A:
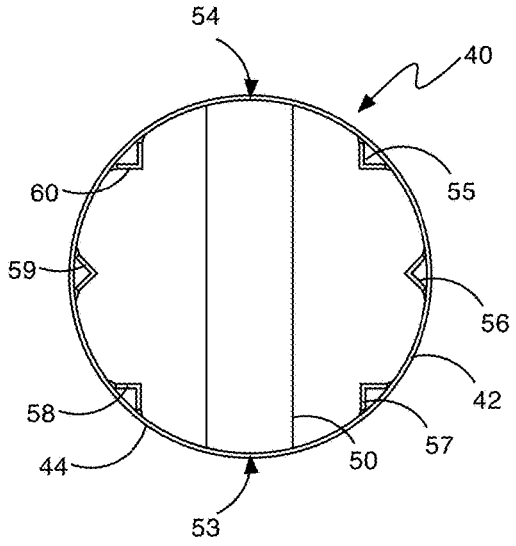
FIG. 2A is a top view of a second embodiment of a support in accordance with the principles of the present invention.
Figure 2C:
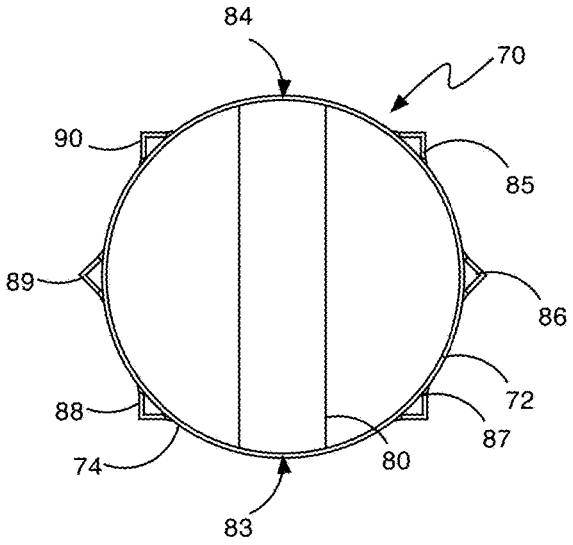
FIG. 2C is a top view of a third embodiment of a support in accordance with the principles of the present invention.
Figure 2B:
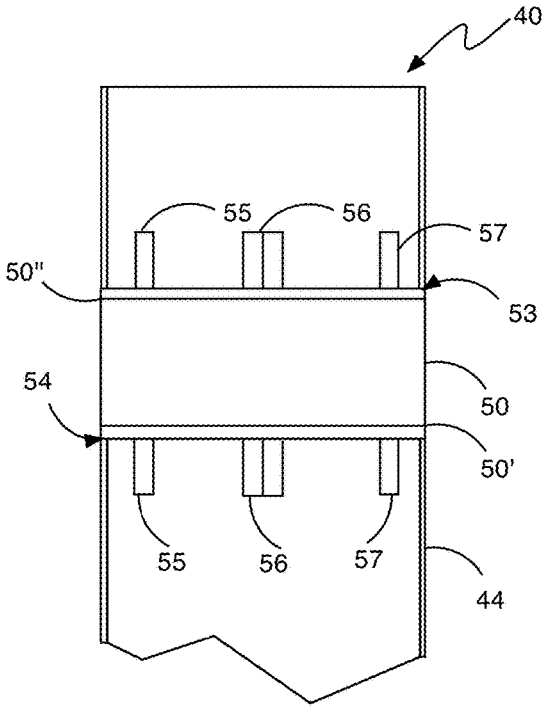
FIG. 2B is a partial cross-sectional side view of the support shown in FIG. 2A.

As shown in FIGS. 2A and 2B, a support, generally indicated at 40, is configured similarly to the support 10 illustrated in FIG. 1A, having each tube, such as tube 50, diametrically extending across the shell 44 of support section 42 between apertures 43 and 44. The tube 50 may have a length substantially equal to a diameter of the shell 44 so that the ends of the tube 50 are positioned proximate the outer surface of the shell 44 at the apertures 53 and 54. In this position, the ends 50' and 50" of the tube 50 can be welded to the shell 44 around each respective aperture 53 and 54. Thus, the outer diameter of the tube 50 is approximately equal to an just slightly smaller than the diameters of the apertures 53 and 54 to allow the tube 50 to be inserted through the apertures 53 and 54 and welded to the shell 44. In addition, positioned within the shell 44 and attached to the inner wall thereof are a plurality of stiffening members 55-60. The stiffening elements 55-60 are longitudinally aligned relative to the shell 44 and are relatively equally spaced along the inside surface of the shell 44 between the apertures 53 and 54. The stiffening elements 55-60 extend at least a diameter the tube 50. As shown, the stiffening elements 55-60 extend above and below the tube 50 so as to provide additional yield strength to the length of the shell 44 to which the stiffening elements 55-60 are attached, i.e., proximate the tube 50. The stiffening elements 55-60 may extend a few inches above and below the tube along the support 40. This added yield strength to the shell 44 in the area of the tube 50 prevents the support 40 from collapsing in the zone in which the tube 50 resides allowing the support 40 to yield in zones above and below the stiffening elements 55-60 while preventing collapse of the support 40 proximate the tube 50, which could in turn cause the tube 50 to collapse. The stiffening elements 55-60 may be formed of angled steel members (e.g., angle iron) that are welded along the edges of the stiffening elements 55-60 that are in contact with the tube 50 to secure the stiffening elements 55-60 to the tube 50 substantially along their entire length. In addition, because the stiffening elements 55-60 are attached to the inside of the support 50, the stiffening elements 55-60 are embedded within the filler material within the support 70 that helps to maintain the stiffening elements on position and also helps to prevent buckling of the stiffening elements 55-60 This ensures that the entire region of the shell 44 defined by the stiffening element 55-60 around the tube 50 is strengthened by the stiffening elements 55-60. It should be noted that while the stiffening elements 55-60 are illustrated as being formed from elongate angled members, the stiffening elements 55-60 are not limited to any particular structural shape or configuration and may include other elongate structures that can be attached to the shell 44 in order to longitudinally strengthen the shell 44 to prevent yielding in a particular area of the support 40 proximate the tube 50.

Figure 2D:
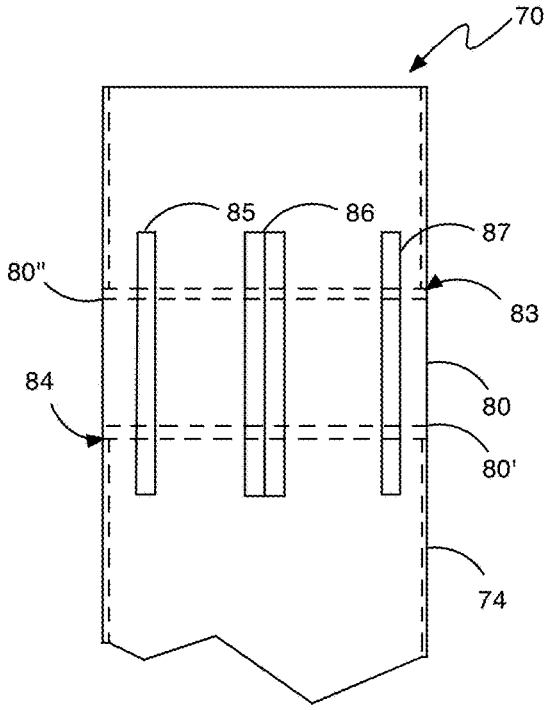
FIG. 2D is a partial cross-sectional side view of the support shown in FIG. 2C.

FIGS. 2C and 2D illustrate another embodiment of a support, generally indicated at 70, having a plurality of stiffening members 85-90 and being configured similarly to the support 40 illustrated in FIG. 1A. The support 70 includes a tube, such as tube 80, diametrically extending across the shell 74 of support section 72 between apertures 73 and 74. The tube 80 may have a length substantially equal to a diameter of the shell 74 so that the ends of the tube 80 are positioned proximate the outer surface of the shell 74 at the apertures 83 and 84. In this position, the ends 80' and 80" of the tube 80 can be welded to the shell 44 around each respective aperture 83 and 84. Thus, the outer diameter of the tube 80 is approximately equal to an just slightly smaller than the diameters of the apertures 83 and 84 to allow the tube 80 to be inserted through the apertures 83 and 84 and welded to the shell 74. In addition, positioned on the outside surface of the shell 74 and attached to the outer wall thereof is a plurality of stiffening members 85-90. The stiffening members 85-90 are longitudinally aligned relative to the shell 44 and are relatively equally spaced around the outside surface of the shell 74 between the apertures 73 and 74. The stiffening members 85-90 extend above and below the tube 80 so as to provide additional yield strength to the length of the shell 74 to which the stiffening members 85-90 are attached. This added yield strength to the shell 74 in the area of the tube 80 prevents the support 70 from collapsing in the zone in which the tube 80 resides allowing the support 70 to yield in zones above and below the stiffening members 85-90 while preventing collapse of the support 70 proximate the tube 80, which could in turn cause the tube 50 to collapse. It should be noted that such stiffening members

85-90 are also provided along the area of the support 70 in which the other tube of the support 70 resides, such as by way of example, the tube 22 shown in FIG. 1A. Again, the stiffening members 85-90 may be formed of angled steel members (e.g., angle iron) that are welded along their edges that are in contact with the outer surface of the tube 70 to secure the stiffening members 85-90 to the tube 80 substantially along their entire length. This ensures that the entire region of the shell 74 defined by the stiffening members 85-90 around the tube 80 is strengthened by the stiffening members 85-90. It should be noted that while the stiffening members 85-90 are illustrated as being formed from elongate angled members, the stiffening members 85-90 are not limited to any particular structural shape or configuration and may include other elongate structures that can be attached to the shell 74 in order to longitudinally strengthen the shell 74 to prevent yielding in a particular area of the support 70 proximate the tube 80.

Figure 3:
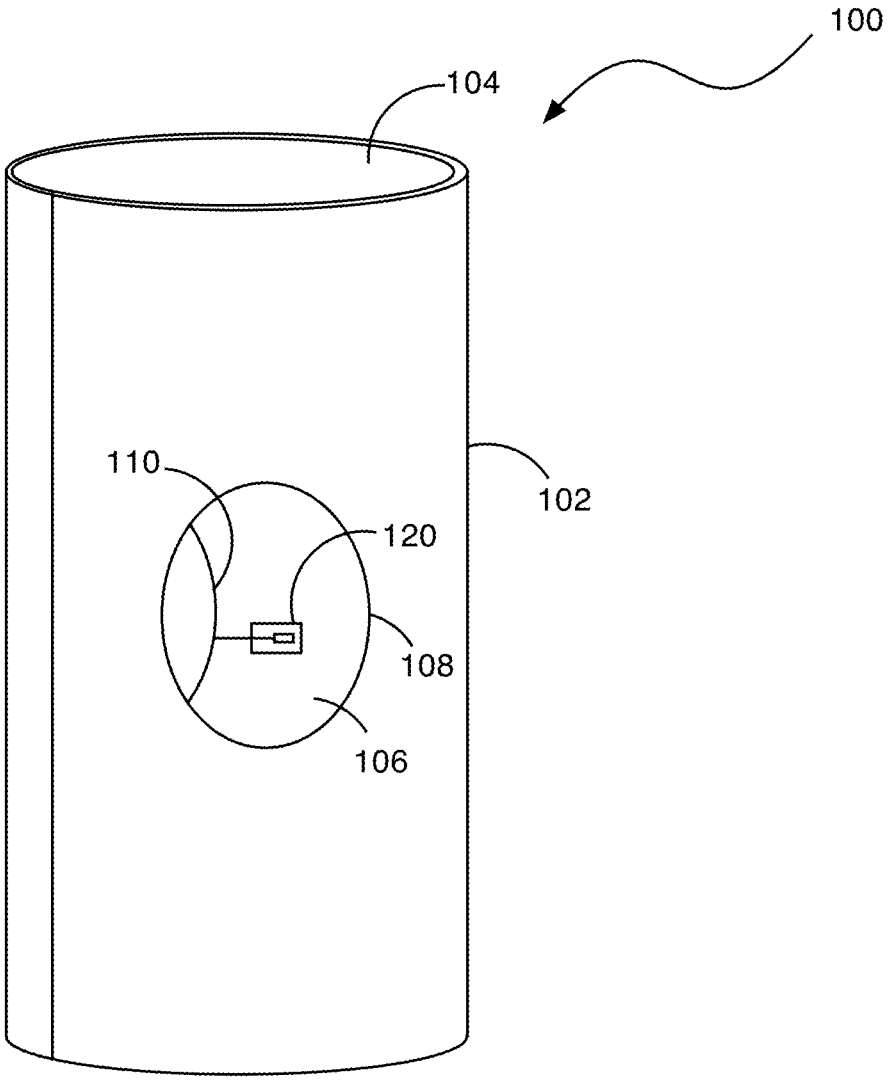
FIG. 3 is a perspective side view of a fourth embodiment of a support in accordance with the principles of the present invention.

As shown in FIG. 3, an alternative embodiment of a support, generally indicated at 100, in accordance with the principles of the present invention is illustrated. The support 100 is generally configured similarly to the support 10 with a cylindrically shaped outer shell 102 filled with aerated concrete 104. The support 100 includes a single transversely extending tube 106 that is attached to and extends through a center of the shell 102. The tube 106 is attached to the shell 102 between apertures 108 and 110 formed in the shell 102. The diameter of the tube 106 defines an area substantially equal to the combined areas defined by tubes 23 and 24 of the support 10 shown in FIG. 1A. The diameter of the tube 106 is approximately ⅓ or less the diameter of the shell 102. This allows the support 100 with a single transversely extending air duct to allow the same flow of air through the support 100 as a flow of air through the two tubes 23 and 24 of support 10 shown in FIG. 1A. For example, if the tubes 23 and 24 each have an inside diameter of 6 inches, the combined area defined by the open ends of the tubes 23 and 24 of approximately 56.52 inches squared. A single tube having an 8.5 inch inner diameter would provide substantially the same area for the flow of air through the support 100 as two 6 inch tubes.

For a predicted load carrying capacity of the support of the present invention, the air ventilation tubes (or air ducts), are configured to withstand the predicted load without crushing. Because the air ventilation tubes are encapsulated in the filler material, the filler material helps to support the sides of the air ventilation tubes as the support carries the load. Once the filler material around the air ventilation tubes is crushed, the air ventilation tubes will be subjected to the full load being carried by the support. Because a smaller diameter tube of a certain wall thickness has more load carrying capacity than a larger diameter tube of the same wall thickness, a number of smaller tubes of thinner wall section may be employed to reduce the wall thickness of each tube while the combined diameters provide sufficient air flow through the support. The required wall thickness of each air ventilation tube is dependent upon the type of steel or other material used to form each tube as well as diameter of the tube. For a 6 inch diameter steel pipe of carbon steel, the pressure to collapse the pipe is approximately 103.2 psi for a wall thickness of 0.109 inches and 315.2 psi for a wall thickness of 0.134 inches. Thus, in order to determine the size of pipe necessary to support a 200,000 pound load for a 22 inch diameter support, the pressure applied to the support under such load is the force (in pounds) divided by the area of the top surface of the support. By this calculation, the pressure of a 200,000 pound load is 526.4 psi. A 5 inch diameter carbon steel pipe having a wall thickness of 0.134 inches is predicted to collapse at 532 psi and should therefore sufficiently support a 2000,000 pound load on the support without collapsing. By enlarging the diameter of the support, however, the pressure on the air ventilation tube will be lower. Thus, for the same 200,000 lb load, a 24 inch diameter support will require air ventilation tubes capable of withstanding 442 psi of pressure.

As further illustrated in FIG. 3, an air flow sensor 120 may be positioned within the tube 54 to detect air flow (e.g., cfm) through the support 100. The air flow sensor 120 may be wired or use telemetry to report air flow to a remote location. If the sensor detects a significant decrease in air flow, mine personnel can be alerted to either a malfunction of air flow equipment or a collapse of the mine entry where the air flow sensor 120 is located. The sensor 120 may also detect other atmospheric conditions in the mine entry such as the presence or levels of various gasses such as oxygen, methane, carbon monoxide, carbon dioxide and others.

Figure 4:
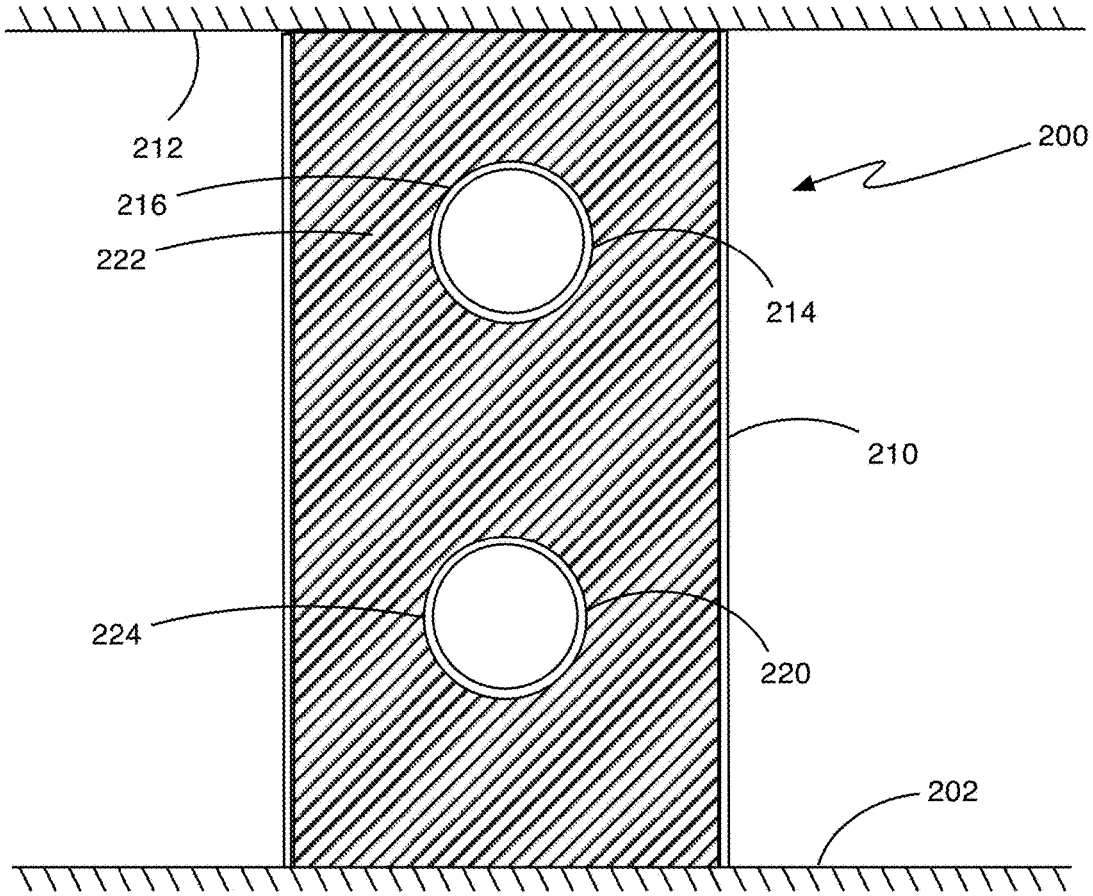
FIG. 4 is a cross-sectional side view of the support shown in FIG. 1A installed in a mine entry.
Figure 5:
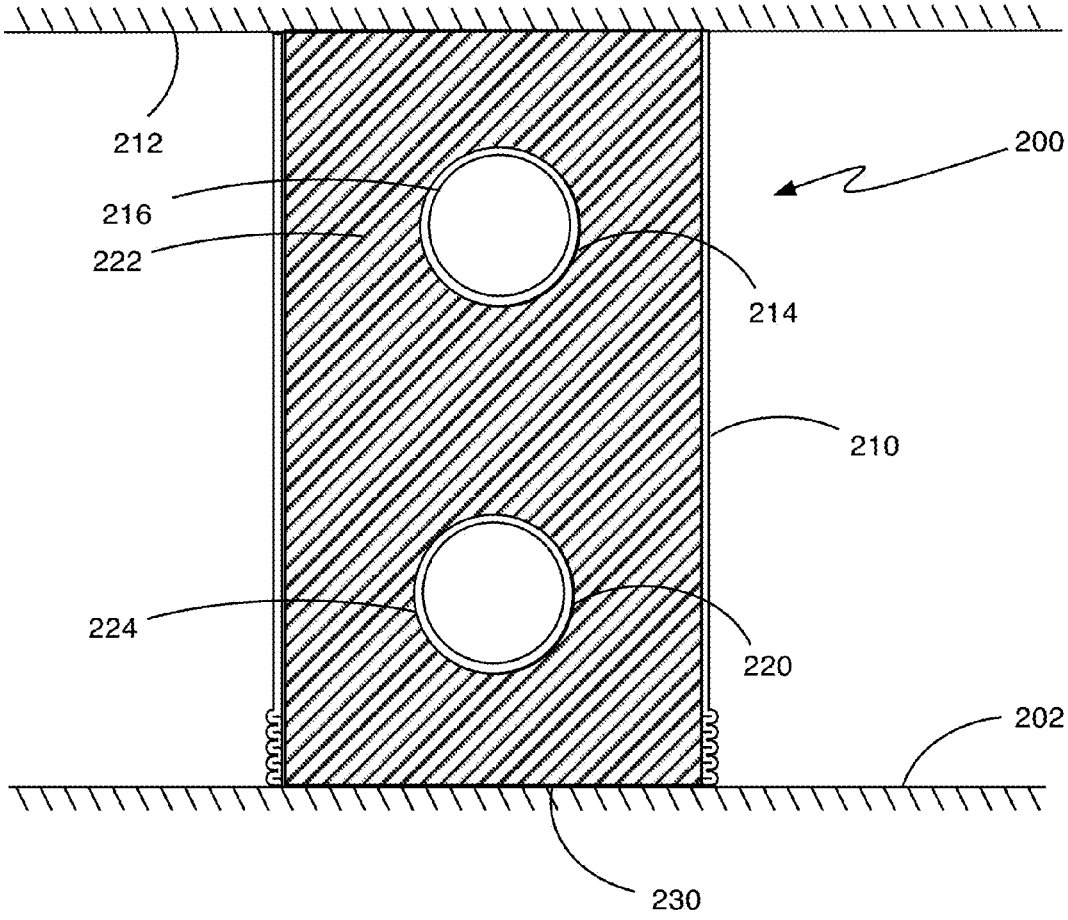
FIG. 5 is a cross-sectional side view of the support shown in FIG. 4 in a first stage of yielding.

As shown in cross-section in FIG. 4, the support 200 according to the principles of the present invention is installed in a mine entry between a floor 202 and a roof 212 of the mine. The support 200 is comprised of an outer steel shell 210 a pair of transversely extending tubes 214 and 220 that are embedded within a lightweight aerated concrete 222 that has been cast into the shell 210 and encapsulates the sides 216 and 224 of the tubes 214 and 220, respectively. As shown in FIG. 5, as the support 200 begins to yield as the floor 202 and roof 212 begin to converge, one end 230 (in this case the bottom) of the support 200 will begin to compress as the filler material 22 is crushed and the shell 210 begins to fold upon itself in an accordion-style manner due to plastic deformation of the outer shell 210 as illustrated and the filler material 222 will begin crushing to form a section of higher density filler material. In this way, the lower tube 220 is effectively moved closer to the bottom 230 of the support.

Figure 6:
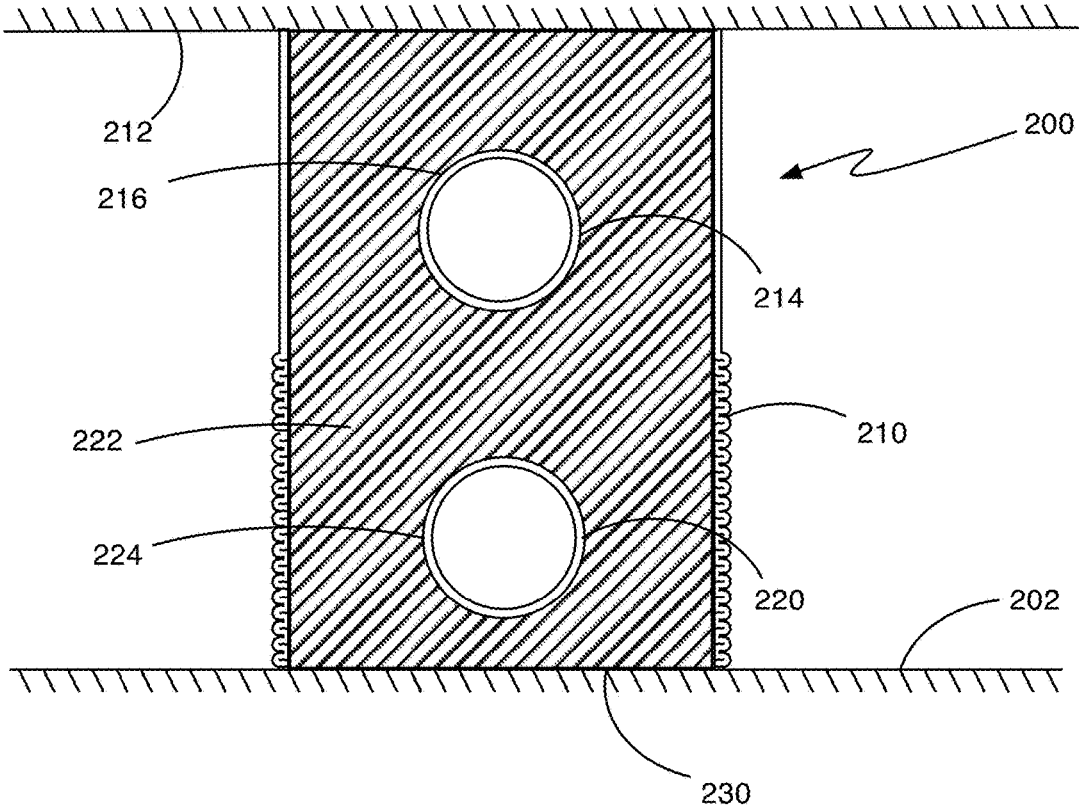
FIG. 6 is a cross-sectional side view of the support shown in FIG. 4 in a second stage of yielding.

As shown in FIG. 6, as the filler material 222 continues to compress and the shell 210 continues to fold upon itself, the tube 220 remains above the bottom surface 230 of the support 200 and thus above the floor 202 of the mine entry. The tube 220 is thus configured to withstand the load being applied to the support 200 as it is fully encased in compressed filler material 222 by residing in the portion of the support 200 that has yielded under the load. If the tube 220 were to also yield under the load, the tube 220 would collapse and flatten along its length causing the tube 220 to close.

Figure 7:
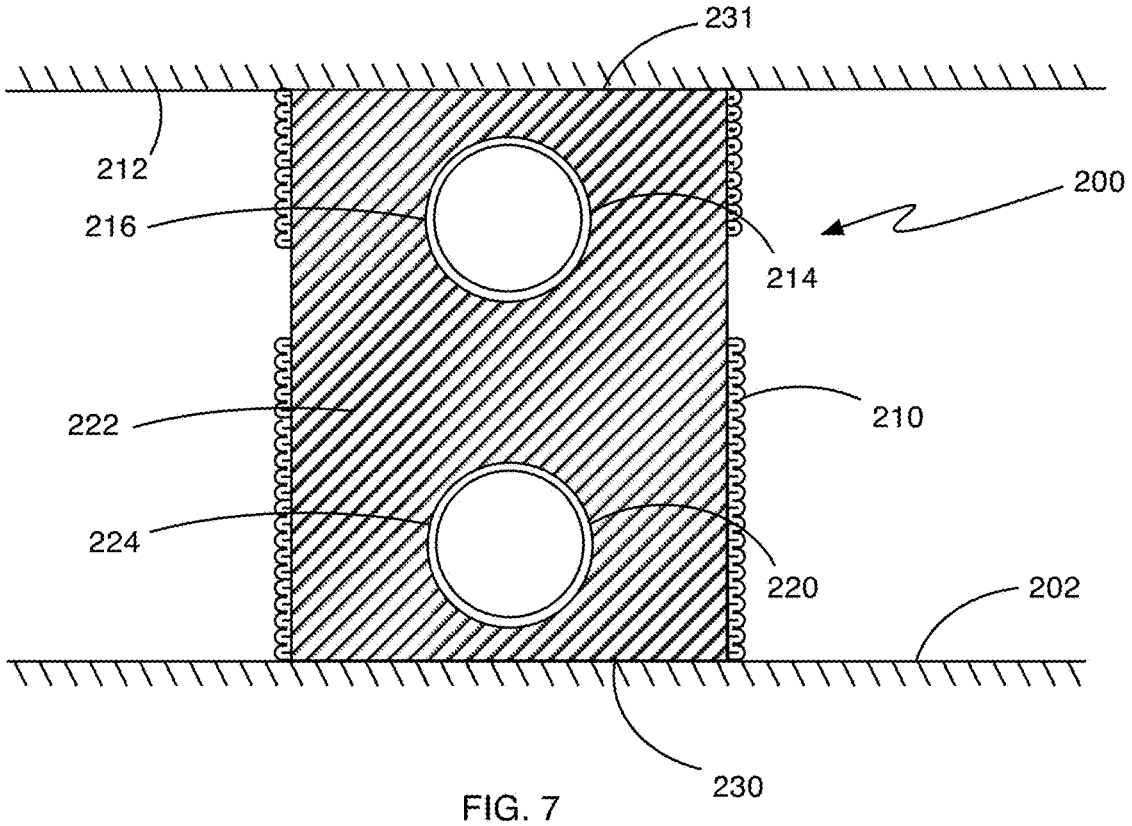
FIG. 7 is a cross-sectional side view of the support shown in FIG. 4 in a third stage of yielding.

As shown in FIG. 7, as the support 200 continues to yield, the opposite end 231, at some point, will also yield under the load in a manner similar to the end 230. That is, the lower end section will continue to yield along its length while the outer shell 210 maintains sufficient hoop strength to contain the compressed filler 222 without bulging or lateral buckling. At some point, the upper section will also begin yielding, again with the outer shell 210 folding upon itself in an accordion-style manner due to plastic deformation of the outer shell 210 as the filler material 222 crushes within the shell 210 to form a section of higher density where the support 200 has yielded. The support 200 will continue to yield until the filler material 222 is substantially fully compressed causing either the support 200 to fail or the support 200 to effectively punch through the roof 212 or the floor 202, in which case the roof 212 will collapse around the support 200. At this point, however, the support has effectively performed as expected.

As such, the tube 214 will effectively move closer to the end 231 as the surrounding filler material 222 is crushed by the load with the tube 214 bearing the weight of the load being applied without collapsing. Because the tubes 214 and 220 remain open until the support 200 has completely or nearly completely yielded, a passage defined by the tubes 214 and 220 remains open for the passage of ventilation air. This is particularly important as the supports reach the stage of yielding as shown in FIG. 7. That is, typically when the support 200 is no longer capable of yielding, the mine entry will eventually collapse around the support 200. Until complete collapse has occurred, however, even though the space between the roof 212 and floor 202 has significantly diminished and other nearby areas in the mine entry may have very well experienced some level of collapse, ventilation air can still pass through the tubes 214 and 220 of the support 200. In the case of a catastrophic and unpredicted mine roof collapse, if the supports of the present invention can continue to maintain air flow through the mine entry, the lives of any trapped miners can be saved since there is still some amount of ventilation air that can pass through the mine supports. For example, as shown schematically in FIGS. 11 and 12, when the supports 200 of the present invention are arranged in a mine entry 250 as per mining engineering specifications, the space between the supports 200, given the distance between the roof and floor of the entry 250 is typically sufficient for adequate air flow, as indicated by the arrow, (although the ventilation tubes in each support 200 enhance the flow of air through the entry 250). The supports 200 are oriented with the air ventilation tubes substantially aligned with the flow of air through the mine entry. When the floor 202 and roof 212 converge (which may be a 50% decrease in distance between the floor 202 and roof 212), however, the ventilation tubes of the supports 200 combine to provide a significantly greater proportion of the air flow through the entry 250.

Figure 8:
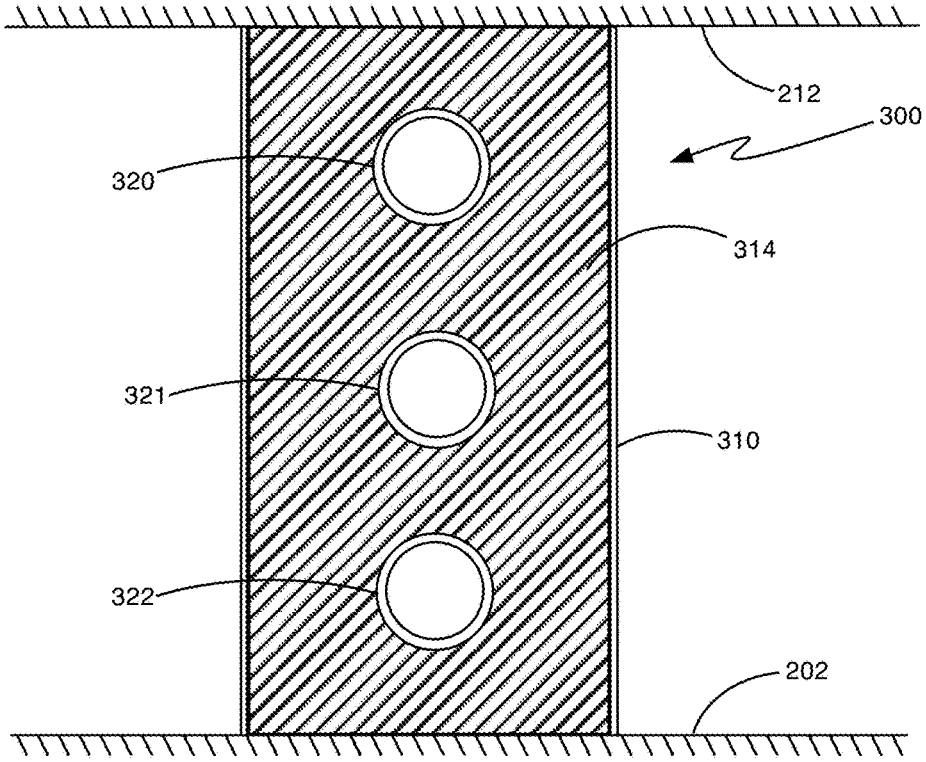
FIG. 8 is a cross-sectional side view of a fifth embodiment of a support in accordance with the principles of the present invention installed in a mine entry.
Figure 9:
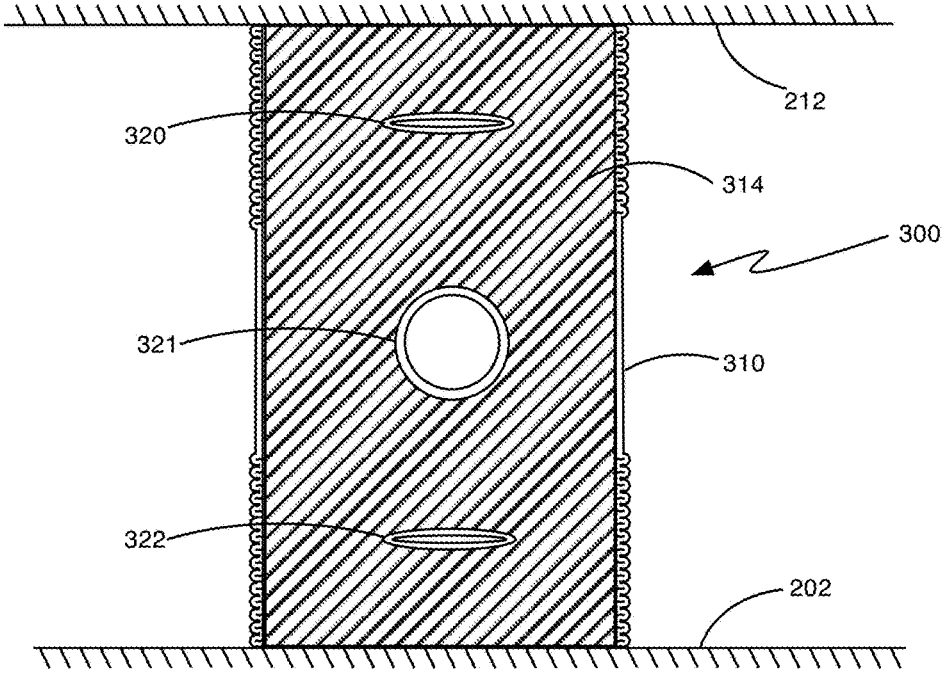
FIG. 9 is a cross-sectional side view of the support shown in FIG. 8 in a stage of yielding.

As shown in FIG. 8, yet another embodiment of a support, generally indicated at 300, in accordance with the principles of the present invention is illustrated. The support 300 is configured similarly to the support 10 illustrated in FIG. 1A with a cylindrical outer shell 310 surrounding a compressible filler material 314. The support 300 is installed in a mine entry between a floor 202 and a roof 212. The support 300 includes three air ducts 320, 321 and 322 formed from elongate metal tubes that extend through the outer shell 310 and filler material 314. The use of three tubes 320, 321 and 322 may be advantageous because the diameter of each tube 320, 321 and 322 may be made smaller. Using the same wall thickness of material for each tube as the dual tube arrangement shown in FIG. 1A allows each of the smaller tubes 320, 321 and 322 to support more load than each of the larger tubes shown in FIG. 1A. Also, as shown in FIG. 9, by providing more tubes 320, 321 and 322, if one or more tubes 320 and 322 becomes plugged or is caused to collapse, it is likely that one or more of the remaining tubes 321 will remain open to allow ventilation through the support 300. Thus, if the tubes 320 and 322 that are in the collapsed zones of the support do in fact collapse because of unexpected or excessive loads, the tube 321 will remain open to provide some ventilation through the support 300.

Figure 10:
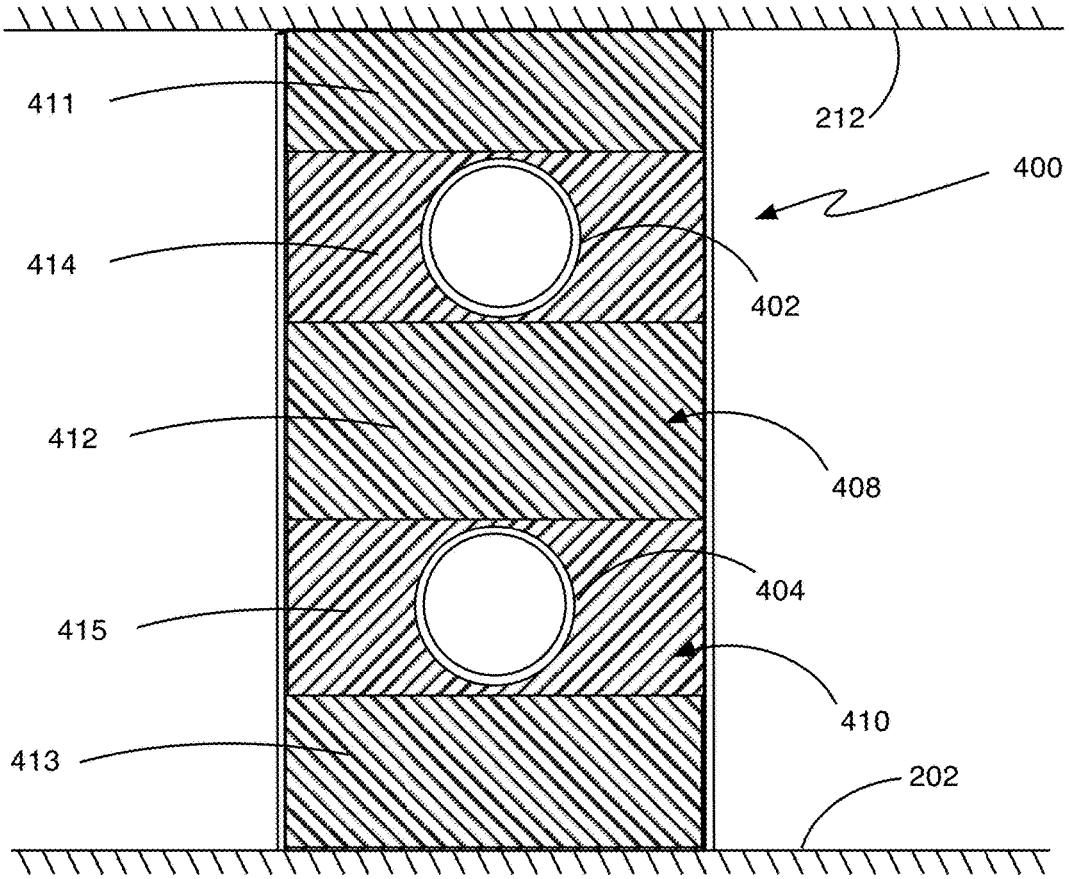
FIG. 10 is a cross-sectional side view of a sixth embodiment of a support in accordance with the principles of the present invention installed in a mine entry.

FIG. 10 illustrates yet another embodiment of a support, generally indicated at 400, in accordance with the principles of the present invention. The support 400 includes a pair of ventilation tubes 402 and 404 that extend through the body of the support 400 as previously described with reference to other embodiments herein. The filler is comprised of filler materials 408 and 410 having different densities. For example, the filler materials 408 and 410 may both be aerated concrete but of different densities. The density of the filler material 408 in the sections 411, 412 and 413 above and below the tubes 402 and 404 have a lower density than the filler material 410 in the sections 414 and 415 surrounding and encapsulating the tubes 402 and 404. As such, the sections 411, 412 and 413 will succumb to yielding before the sections 414 and 415 around the tubes 402 and 404. As such, crushing of the filler material 410 in sections 414 and 415 will occur after the filler material 408 in sections 411, 412 and 413 has been substantially crushed. Thus, the filler material 410 supports the tubes 402 and 404 within the support 400 as the support 400 yields. As a result, the tubes 402 and 404 may be formed from a thinner walled steel or other material than would otherwise be required if the filler material 410 around the tubes 402 and 404 were allowed to yield as the support 400 yields. In such a case, once the sections 411, 412 and 413 have substantially completely yielded, because the filler material 410 is also compressible, the filler material 410 and even the tubes 402 and 404 will allow the support 400 to continue to yield as it supports the roof 212 and floor 202 of the mine entry as the roof 212 and floor 202 continue to converge.

Figure 11:
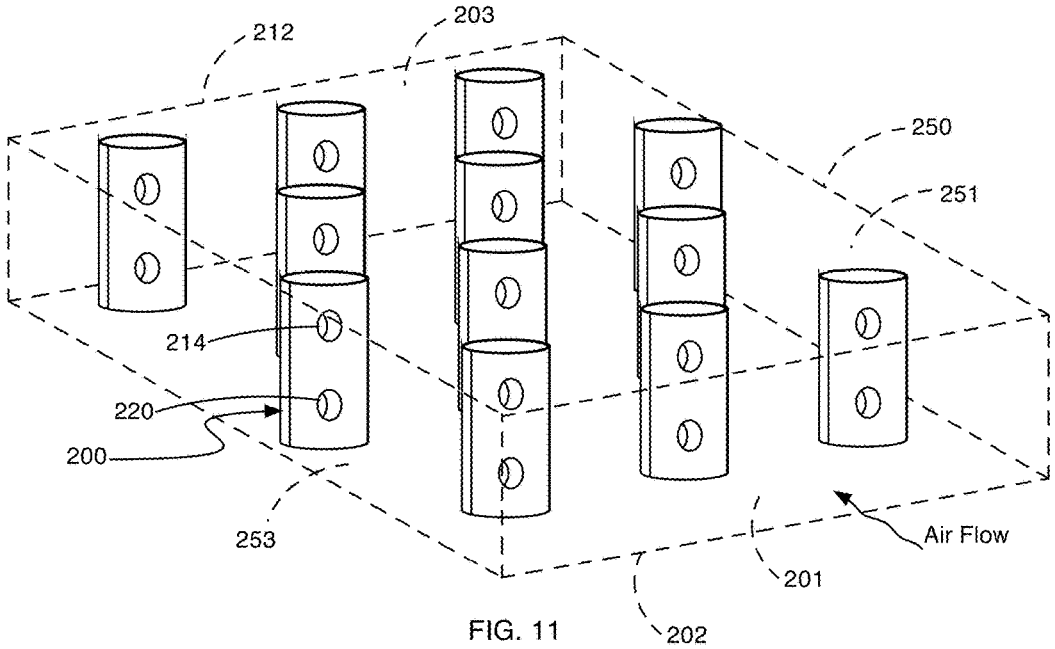
FIG. 11 perspective side view of a plurality of supports installed in a mine entry in accordance with the principles of the present invention.
Figure 12:
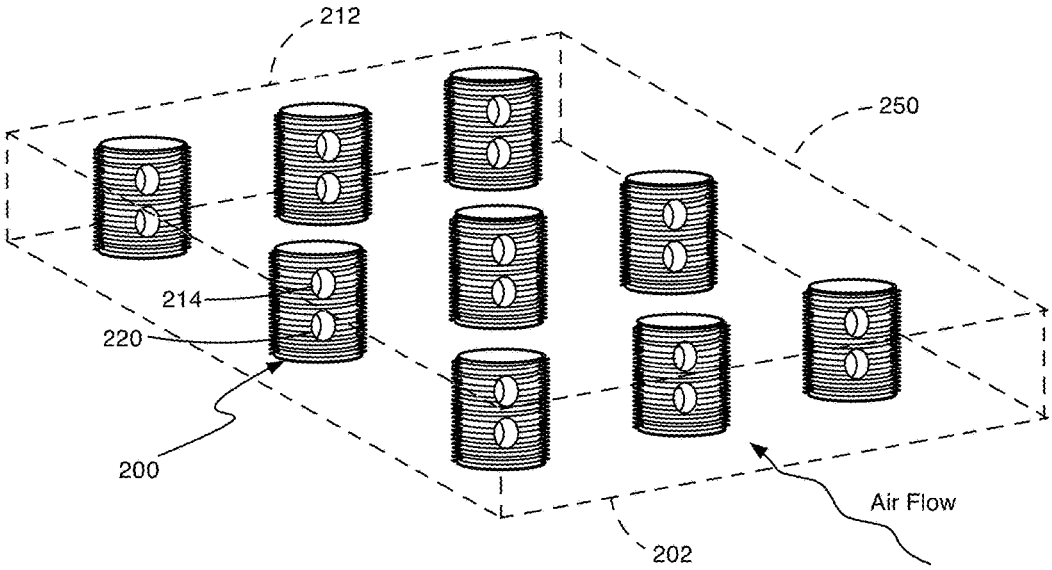
FIG. 12 perspective side view of a plurality of supports installed in a mine entry in a collapsed state in accordance with the principles of the present invention.

As shown in FIG. 11, a number of supports, such as support 200, are arranged in a mine entry 250. The supports 200 are installed between the floor 202 and roof 212 of the entry 250 and are utilized to support a particular section of the entry 250 represented by dashed lines. The left and right sides 251 and 253 of the entry 250 represent the side walls of the entry with the front 201 and rear 203 ends of the entry 250 being open to other sections of the mine. Thus, ventilation air, represented by the arrow, flows through the entry 250 from the front 201 to the rear 203. The supports 200 are oriented with the ventilation tubes 214 and 220 oriented with the longitudinal axis of the ventilation tubes 214 and 220 being generally aligned with the general direction of air flow through the entry 250, that is with the openings of the tubes 214 and 220 generally facing the front and back of the entry 250. As the floor 202 and roof 212 converge as shown in FIG. 12 and the supports 200 yield, the velocity of the air increases, as represented by the larger arrow, but the volume of air that passes through the entry 250 actually decreases due to the constriction. With the ventilation tubes 220 and 214 remaining open as the supports 200 yield, the volume of air that can pass through the entry 250 is increased by the combined area of each ventilation tube of all of the supports in the mine entry section that has experienced convergence. Thus, as the mine entry converges, the area defined by the sum of all ventilations tubes of supports 200 in that section becomes a larger percentage of the total area of through which the air can flow, thus providing increased air flow volume through the entry 250 compared to similarly sized supports without such ventilation tubes.

The supports of the present invention are designed to carry an average load of at least approximately between about 100,000 lbs and about 350,000 lbs depending on the size of the support and the initial density of the compressible filler material. For example, the compressible filler material may comprise aerated or foamed concrete, lightweight cement, grout or other material known in the art having density of approximately 40 to 50 lb/ft$^3$. For greater load carrying capability, the compressible filler material may comprise aerated or foamed concrete, lightweight cement, grout our other materials known in the art having density of approximately 50 to 60 lb/ft$^3$. The outer shell is formed by sheet rolling techniques to form a tube from a flat sheet of steel. Such steel may have a thickness of approximately 0.075 to 0.09 inches of 1008 steel. The tube is then welded at a seam along the entire length of the tube to form the cylindrical shell of the present invention. The air ducts may be formed from similar sheet rolling techniques to form a tube from a flat sheet of steel. Such steel may have a thickness of 1008 steel dependent upon the anticipated load carrying capacity of the support. The air ducts are then welded at a seam along the entire length of the air duct to form a cylinder having a length approximately equal to a diameter of the shell of the support. Likewise, steel pipe having a particular diameter and wall thickness may be used to form the outer shell or air ducts. In addition, the shell and/or air ducts may be formed by an extrusion process or other methods known in the art. The support generally will longitudinally yield when subjected to a longitudinal force or load. The support will yield in one or more yield zones by allowing the outer tube or shell to fold upon itself in a plurality of folds as the filler material compresses while the air ducts remain open as the filler material and outer shell yield around the air ducts. Thus, the support longitudinally yields without releasing the load while maintaining air flow through the support.

Various fillers and combinations of fillers may be employed in the supports. For example, the filler material may comprise aerated concrete mixtures of one or more densities. Likewise, the upper support section may include compressible fillers, such as pumas or hollow glass spheres that may be encapsulated within other binding agents or other materials, such as cement, grout or foam to hold the filler material together and to the inside of the outer shell.

Figure 13:
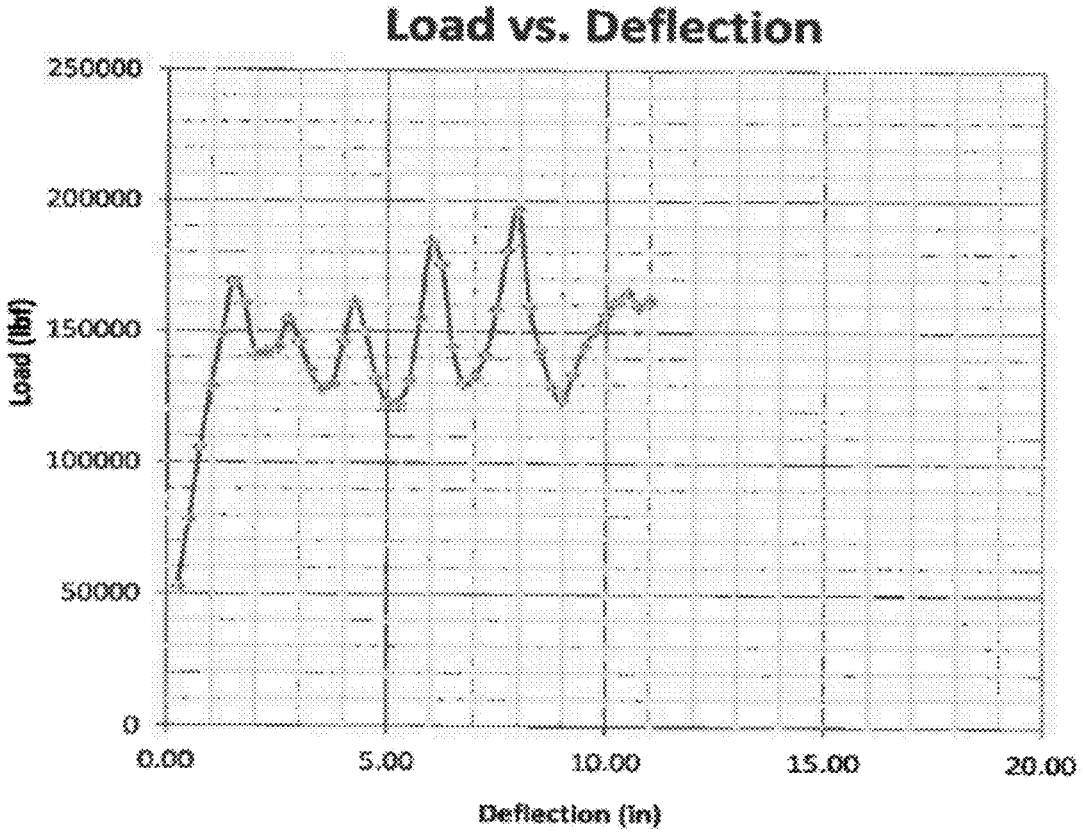
FIG. 13 is a first graphical representation of test results illustrating support load versus displacement for a support in according to the principles of the present invention.
Figure 14:
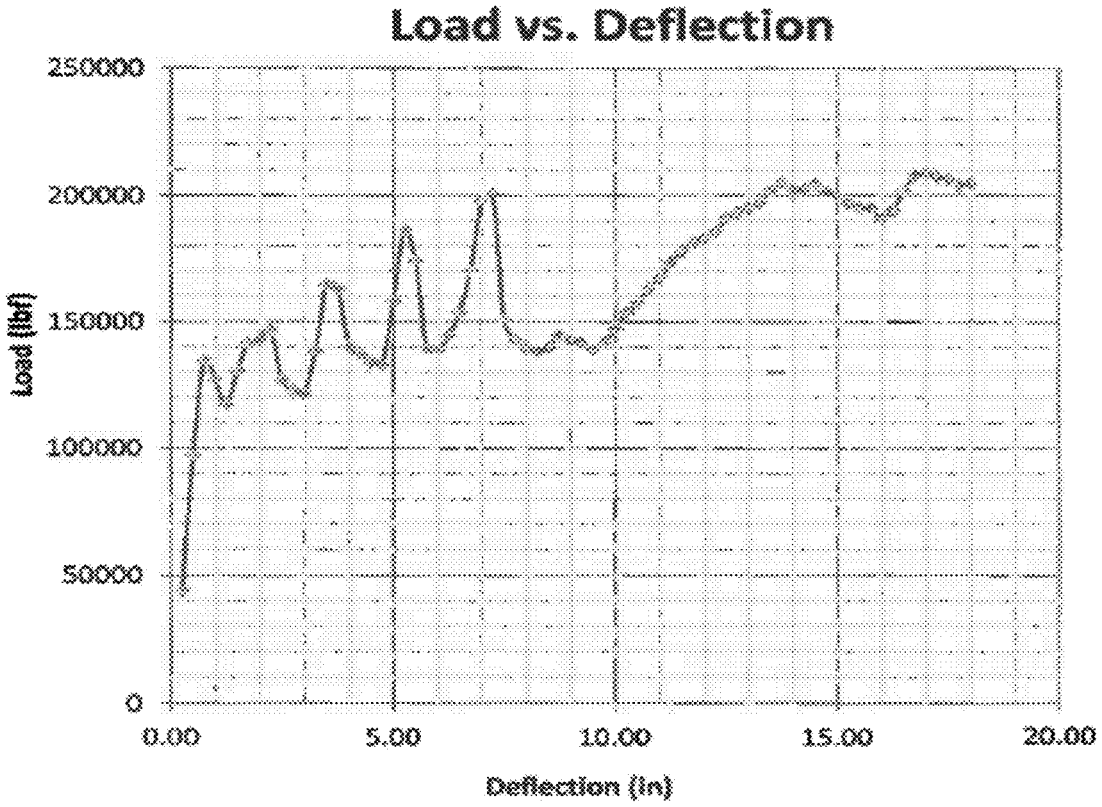
FIG. 14 is a second graphical representation of test results illustrating support load versus displacement for a support in according to the principles of the present invention.

By way of example of the loads that can be supported by a support in accordance with the present invention, several tests have illustrated the impressive load supporting capabilities of the mine support in accordance with the present invention. FIGS. 13 and 14 are graphical representations of actual test results conducted at a testing lab in Pittsburgh, Pa. FIGS. 13 and 14 illustrate load versus deflection for two tests conducted on two supports configured in accordance with the principles of the present invention. In FIG. 13, the support had a 22 inch diameter and 5 feet height with a single 6 inch diameter air duct formed from 14 gauge steel. The support maintained a maximum load capacity of approximately 200,000 lbs while experiencing 11 inches of deflection. Importantly, the support predictably maintained a load of between about 120,000 lbs to 200,000 lbs over the course of the test. The test results indicate that the support behaved predictably and in a normal manner over the range of deflection tested.

In FIG. 14, the support had a 22 inch diameter and 5 feet height with two 6 inch diameter air ducts formed from 14 gauge steel, similar to the configuration shown in FIG. 1A. The support maintained a maximum load capacity of over 200,000 lbs while experiencing 18 inches of deflection. Importantly, the support predictably maintained a load of between about 120,000 lbs to 210,000 lbs over the course of the test. The test results indicate that the support behaved predictably and in a normal manner over the range of deflection tested.

Accordingly, each test support behaved in a predictable manner that continued to yield while supporting at least a particular load. This allows mine engineers to place the supports at various locations and distances throughout a mine entry where the loads to be supported are relatively predictable. Moreover, because each support gradually increases in load bearing capacity while continuing to yield, there is no unexpected drop in load bearing capacity of the supports that could result in a localized failure. With respect to each test, the data shows a sine-type wave pattern where the load bearing capacity varies as the support is compressed. This is a result of the folding of the outer shell of the support. That is, when the outer shell of the support is experiencing plastic deformation when the shell is forming a fold, the load bearing capacity will decrease slightly until the fold is complete at which point the load bearing capacity will slightly increase. This repeats with each successive fold of the outer shell of the support until the support has reached its maximum compression (typically about half its original height). As illustrated, however, while the occurrence of each fold changes the load bearing capacity of the support, the upper and lower load bearing capacity of the support during and after a fold is within a relatively constant range, again producing a predictable load bearing capacity of the support even as the support yields.

The supports according to the present invention can also maintain a support load of even during several inches of vertical displacement of the upper end of the support relative to the bottom end. This allows the support to continue to bear a load even if the floor and roof of the mine entry laterally shift relative to one another. Thus, even in a condition where horizontal shifting of the mine roof or floor occurs, the mine support according to the present invention continues to support significant loads.

While the present invention has been described with reference to certain illustrative embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. It should be noted that reference to the terms "shell", "tube" or "pipe" are intended to cover shells, tubes or pipes of all cross-sectional configurations including, without limitation, round, square, or other geometric shapes. In addition, reference herein to a use of the support in a mine entry or underground mine according to the present invention is not intended in any way to limit the usage of the support of the present invention. Indeed, the support of the present invention may have particular utility in various tunnel systems or other applications where a yieldable support post is desired. The claims provided herein are intended to cover such modifications and combinations and all equivalents thereof. Reference herein to specific details of the illustrated embodiments is by way of example and not by way of limitation.

Thus, aspects and applications of the invention presented here are described in the drawings and in the foregoing detailed description of the invention. Those of ordinary skill in the art will realize that the description of the present invention is illustrative only and not in any way limiting. Other embodiments of the invention will readily suggest themselves to such skilled persons including, without limitation, combinations of elements of the various embodiments. Various representative implementations of the present invention may be applied to any heating system.

Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use the plain and ordinary meaning of terms in the specification and claims unless they clearly state otherwise in which case, the inventor will set forth the "special" definition of that term and explain how it differs from the plain and ordinary meaning. Absent such statements of the application of a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112(f). Thus, the use of the words "function," "means" or "step" in the Detailed Description of the Invention or claims is not intended to somehow indicate a desire to invoke the special provisions of 35 U.S.C. §112(f) to define the invention. To the contrary, if the provisions of 35 U.S.C. §112(f) are sought to be invoked to define the inventions, the claims will specifically and expressly state the exact phrases "means for" or "step for" and the specific function (e.g., "means for heating"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. §112(f). Moreover, even if the provisions of 35 U.S.C. §112(f) are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

What is claimed is:

1. A longitudinally yieldable support, comprising:

an elongate outer shell in the form of a column and defining a first pair of apertures located along a wall of the elongate outer shell, the first pair of apertures each positioned on opposite sides of the elongate outer shell from one another;

a first air ventilation tube having first and second ends attached to the wall and extending transversely through the elongate outer shell at a location of and between the first pair of apertures, an outer tube diameter of the first air ventilation tube being approximately equal to an aperture diameter of the first pair of apertures; and a solid compressible filler material disposed within the elongate outer shell and encapsulating the first air ventilation tube within the elongate outer shell;

the first air ventilation tube having a wall thickness sufficient to prevent the first air ventilation tube from collapsing as the elongate outer shell and solid compressible filler material yield around the first air ventilation tube such that the first air ventilation tube does not collapse or yield when the elongate outer shell and solid compressible filler material yield to allow a flow of air through the first air ventilation tube as the elongate outer shell and solid compressible filler material yield.

2. The support of claim 1, further comprising a second pair of apertures formed in the elongate outer shell substantially vertically aligned with the first pair of apertures therein, the second pair of apertures each positioned on opposite sides of the elongate outer shell from one another and a second air ventilation tube attached to the elongate outer shell between the second pair of apertures, an outer tube diameter of the second air ventilation tube being approximately equal to an aperture diameter of the second pair of apertures.

3. The support of claim 2, wherein the first and second air ventilation tubes are welded at their respective ends to the elongate outer shell at locations of the first and second pair of apertures, respectively.

4. The support of claim 2, further comprising a third pair of apertures formed in the elongate outer shell substantially vertically aligned with the first and second pair of apertures therein, the third pair of apertures each positioned on opposite sides of the elongate outer shell from one another and a third air ventilation tube attached to the elongate outer shell between the third pair of apertures, an outer tube diameter of the third air ventilation tube being approximately equal to an aperture diameter of the third pair of apertures.

5. The support of claim 2, wherein the first air ventilation tube is positioned approximately one third an overall length of the elongate outer shell from a proximal end of the elongate outer shell and the second air ventilation tube is positioned approximately one third an overall length of the elongate outer shell from a distal end of the elongate outer shell.

6. The support of claim 2, wherein the filler material comprises a first filler material having a first density filling sections of the support above and below the first and second air ventilation tubes and a second filler material having a second density that is greater than the first density of the first filler material filling sections of the support around the first and second air ventilation tubes.

7. The support of claim 6, wherein the first filler material has a density of between about 40 and 50 $lb/ft^3$ and the second filler material has a density of between about 50 and 60 $lb/ft^3$.

8. The support of claim 2, further comprising a first plurality of stiffening elements attached to the outer shell in an area of the shell proximate the first air ventilation tube and extending along the outer shell a distance equal to at least a diameter of the first air ventilation tube and a second plurality of stiffening elements attached to the outer shell in an area of the shell proximate the second air ventilation tube and extending along the outer shell a distance equal to at least a diameter of the second air ventilation tube.

9. The support of claim 1, wherein the elongate outer shell is comprised of steel and wherein the solid compressible filler material is cast in the elongate outer shell.

10. The support of claim 1, wherein the compressible filler material has a density of between about 40 and 50 $lb/ft^3$.

11. The support of claim 1, wherein the compressible filler material has a density of between about 50 and 60 $lb/ft^3$.

12. The support of claim 1, wherein the first air ventilation tube is positioned approximately midway between a proximal end and a distal end of the elongate outer shell.

13. The support of claim 1, wherein the support is capable of supporting a load of at least 100,000 lbs.

14. The support of claim 13, wherein the support is capable of supporting a load of between approximately 100,000 lbs and 300,000 lbs as the support yields under load without collapsing the first air ventilation tube.

15. The support of claim 14, wherein the elongate outer shell is configured to fold upon itself as the support yields.

16. The support of claim 1, wherein the filler material comprises a first filler material having a first density filling sections of the support above and below the first air ventilation tube and a second filler material having a second density that is greater than the first density of the first filler material filling a section of the support around the first air ventilation tube.

17. The support of claim 16, wherein the first filler material has a density of between about 40 and 50 lb/ft$^3$ and the second filler material has a density of between about 50 and 60 lb/ft$^3$.

18. The support of claim 1, further comprising a plurality of stiffening elements attached to the outer shell in an area of the shell proximate the first air ventilation tube and extending along the outer shell a distance equal to at least a diameter of the first air ventilation tube.

19. The support of claim 1, further comprising at least one stiffening member attached along an inside surface of the shell proximate the first air ventilation tube.

20. The support of claim 1, further comprising at least one stiffening member attached along an outside surface of the shell proximate the first air ventilation tube.

21. A longitudinally yieldable support for supporting a roof in an underground mine, comprising:

a support section in the form of a column and comprising an elongate outer shell comprised of steel, the elongate outer shell defining a first pair of apertures located along a wall of the support section, the first pair of apertures each positioned on opposite sides of the elongate outer shell from one another;

a first air ventilation duct having first and second ends attached to the elongate outer shell, the first air ventilation duct transversely extending across the elongate outer shell between the first pair of apertures, an outer diameter of the first air ventilation duct being approximately equal to an aperture diameter of the first pair of apertures; and a solid compressible filler material cast within the elongate outer shell and encapsulating the first air ventilation duct within the elongate outer shell;

the first air ventilation duct having a wall thickness sufficient to prevent the first air ventilation duct from collapsing or yielding as the elongate outer shell and solid compressible filler material yield around the first air ventilation duct such that the first air ventilation duct does not collapse or yield to allow a flow of air through the first air ventilation duct as the elongate outer shell and solid compressible filler material yield.

22. The support of claim 21, further comprising a second pair of apertures formed in the elongate outer shell substantially vertically aligned with the first pair of apertures therein, the second pair of apertures each positioned on opposite sides of the elongate outer shell from one another, and a second air ventilation duct attached to the elongate outer shell between the second pair of apertures, an outer diameter of the second air ventilation duct being approximately equal to an aperture diameter of the second pair of apertures, wherein the first and second air ventilation ducts are welded at their respective ends to the elongate outer shell at locations of the first and second pair of apertures, respectively.

23. The support of claim 22, wherein the first air ventilation duct is positioned approximately one third an overall length of the elongate outer shell from a proximal end of the elongate outer shell and the second air ventilation duct is positioned approximately one third an overall length of the elongate outer shell from a distal end of the elongate outer shell.

24. The support of claim 22, wherein the support section is capable of supporting a load of between approximately 100,000 lbs and 300,000 lbs as the support yields under load without collapsing the first and second air ventilation ducts.

25. The support of claim 22, wherein the filler material comprises a first filler material having a first density filling sections of the support above and below the first and second air ventilation ducts and a second filler material having a second density that is greater than the first density of the first filler material filling sections of the support around the first and second air ventilation ducts.

26. The support of claim 25, wherein the first filler material has a density of between about 40 and 50 lb/ft$^3$ and the second filler material has a density of between about 50 and 60 lb/ft$^3$.

27. The support of claim 22, further comprising a first plurality of stiffening members attached to the outer shell in an area of the shell proximate the first air ventilation duct and extending along the outer shell a distance equal to at least a diameter of the first air ventilation duct and a second plurality of stiffening members attached to the outer shell in an area of the shell proximate the second air ventilation duct and extending along the outer shell a distance equal to at least a diameter of the second air ventilation duct.

28. The support of claim 21, wherein the compressible filler material has a density of between about 40 and 50 lb/ft$^3$.

29. The support of claim 21, wherein the compressible filler material has a density of between about 50 and 60 lb/ft$^3$.

30. The support of claim 21, wherein the support section is capable of supporting a load of at least 100,000 lbs.

31. The support of claim 21, wherein the elongate outer shell is configured to fold upon itself as the support section yields.

32. The support of claim 21, further comprising at least one stiffening member attached along an inside surface of the shell proximate the first air ventilation duct.

33. The support of claim 21, further comprising at least one stiffening member attached along an outside surface of the shell proximate the first air ventilation duct.

* * * * *